US006260204B1

(12) United States Patent
Morrissey

(10) Patent No.: US 6,260,204 B1
(45) Date of Patent: Jul. 17, 2001

(54) FLEXIBLE PROTECTOR FOR THE BACK OF THE NECK OF A WEARER OF A HARD HAT

(76) Inventor: Oliver Morrissey, 10 Coffey St., Apt. 25, Dorchester, MA (US) 02122

( * ) Notice: Subject to any disclaimer, the term of this patent is extended or adjusted under 35 U.S.C. 154(b) by 0 days.

(21) Appl. No.: 09/524,584

(22) Filed: Mar. 13, 2000

(51) Int. Cl.[7] ..... A42B 1/06

(52) U.S. Cl. ..... 2/172; 2/209.13; 2/175.6; 2/175.3

(58) Field of Search ..... 2/175.1, 175.6, 2/172, 175.3, 209.13, 195.1, 171, 184.5, 209.3, 10, 207

(56) References Cited

U.S. PATENT DOCUMENTS

| | | | | |
|---|---|---|---|---|
| 350,398 | * | 10/1886 | Shunk | 2/175.6 |
| 1,075,181 | * | 10/1913 | Zick | 2/175.6 |
| 3,166,766 | * | 1/1965 | Banello, Jr. | 2/175.6 |
| 3,469,264 | * | 9/1969 | Harris | 2/187 |
| 4,887,319 | | 12/1989 | Daniels | 2/410 |
| 4,993,081 | | 2/1991 | Fulghum | 2/191 |
| 5,323,491 | | 6/1994 | Barrett, Jr. | 2/207 |
| 5,406,645 | * | 4/1995 | Lin | 2/175.6 |
| 5,694,647 | * | 12/1997 | Crickmore | 2/209.13 |
| 5,701,609 | | 12/1997 | Bridges | 2/422 |
| 5,862,520 | * | 1/1999 | Wyant | 2/175.1 |
| 5,950,241 | * | 9/1999 | Gomez | 2/209.13 |
| 6,061,836 | * | 5/2000 | Peters | 2/175.6 |

FOREIGN PATENT DOCUMENTS

| | | | | |
|---|---|---|---|---|
| 10951 | * | 4/1901 | (GB) | 2/175.6 |
| 15232 | * | 11/1909 | (GB) | 2/175.6 |
| 176070 | * | 2/1922 | (GB) | 2/175.6 |

* cited by examiner

*Primary Examiner*—Amy B Vanatta
(74) *Attorney, Agent, or Firm*—Richard L. Miller, P.E

(57) ABSTRACT

A flexible protector for the back of the neck of a wearer of a hard hat. The protector includes a brim, a drape, and apparatus. The brim receives the crown of the hard hat and rests on the peak of the hard hat. The drape depends from the brim and protects the back of the neck of the wearer of the hard hat. The apparatus is associated with the brim and selectively maintains the brim on the hard hat. The apparatus includes an anterior pocket that releasably captures the anterior portion of the peak of the hard hat, a posterior pocket that releasably captures the posterior portion of the peak of the hard hat, and mating portions of hook and loop fasteners that are disposed on facing surfaces of the brim and the posterior pocket of the apparatus and retains the posterior portion of the peak of the hard hat in the posterior pocket of the apparatus when mated and surrenders the posterior portion of the peak of the hard hat from the posterior pocket of the apparatus when unmated so as to facilitate donning and undonning the flexible protector relative to the hard hat.

4 Claims, 2 Drawing Sheets

FLEXIBLE PROTECTOR FOR THE BACK OF THE NECK OF A WEARER OF A HARD HAT

BACKGROUND OF THE INVENTION

1. Field of the Invention

The present invention relates to a flexible protector for the back of the neck. More particularly, the present invention relates to a flexible protector for the back of the neck of a wearer of a hard hat.

2. Description of the Prior Art

Numerous innovations for head shields have been provided in the prior art that will be described. Even though these innovations may be suitable for the specific individual purposes to which they address, however, they differ from the present invention.

A FIRST EXAMPLE, U.S. Pat. No. 4,887,319 to Daniels teaches a weather protective unitary contiguous substantially flat face and neck cover for use with hard head gear. The cover has an outer layer of non-stretchable waterproof highly reflective nylon having a liner of thermally insulated material. The cover has a top bridge portion above the face of the wearer which terminates in side flaps. Waterproof elastic piping is secured about the free edge of cover to seat tightly about the portions of the hard hat with which it is in contact as well as to seat tightly about the face and neck of the wearer to shut out weather elements such as wind, snow, rain and the like from contact with the wearer over the area covered by the unitary face and neck cover. The side flaps extending off the top bridge portion have flap securing means to maintain the flaps connected at their free ends beneath the chin of the wearer.

A SECOND EXAMPLE, U.S. Pat. No. 4,993,081 to Fulghum teaches a flexible sun shield that is detachably connectable around the circumference of a hard hat or military helmet for shielding eyes, face and neck from excessive sun exposure. The sun shield includes a brim formed of a curved length of flexible, pliable flat material formed generally into the shape of a portion of an oval ring in-the-flat and an upstanding flexible flange connected along the inner margin of the brim. The flange is releasably connectable circumferentially around the hard hat such that the brim extends outwardly and slopes downwardly from the hard hat.

A THIRD EXAMPLE, U.S. Pat. No. 5,323,491 to Barrett, Jr. teaches a device for protective headgear for shielding ears and neck from ultraviolet rays which can be worn alone or in conjunction with a hat. This device is a stretchable headband with a crescent shaped sun shield attached to the headband. The sun shield gathers slightly when worn, and extends outwardly from the head so that it does not lay directly over the ears. The shield is made of a tightly woven material which is also breathable, a single ply or preferably a two-ply material with a tightly woven micro denier on the outside and an all-cotton liner on the underside which will be in contact with the back of the neck. A method for making the device also disclosed.

A FOURTH EXAMPLE, U.S. Pat. No. 5,701,609 to Bridges teaches a substantially rectangular, protective drape which is selectively attachable to a hard hat, preferably includes a strip of "hook and loop" fastener along one edge. A complementary strip of "hook and loop" fastening material is attached to the inner wall of the hard hat. The drape is used to protect the neck and, selectively, the ears, of the user from the elements.

It is apparent that numerous innovations for head shields have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a flexible protector for the back of the neck of a wearer of a hard hat that avoids the disadvantages of the prior art.

ANOTHER OBJECT of the present invention is to provide a flexible protector for the back of the neck of a wearer of a hard hat that is simple and inexpensive to manufacture.

STILL ANOTHER OBJECT of the present invention is to provide a flexible protector for the back of the neck of a wearer of a hard hat that is simple to use.

BRIEFLY STATED, YET ANOTHER OBJECT of the present invention is to provide a flexible protector for the back of the neck of a wearer of a hard hat. The protector includes a brim, a drape, and apparatus. The brim receives the crown of the hard hat and rests on the peak of the hard hat. The drape depends from the brim and protects the back of the neck of the wearer of the hard hat. The apparatus is associated with the brim and selectively maintains the brim on the hard hat. The apparatus includes an anterior pocket that releasably captures the anterior portion of the peak of the hard hat, a posterior pocket that releasably captures the posterior portion of the peak of the hard hat, and mating portions of hook and loop fasteners that are disposed on facing surfaces of the brim and the posterior pocket of the apparatus and retains the posterior portion of the peak of the hard hat in the posterior pocket of the apparatus when mated and surrenders the posterior portion of the peak of the hard hat from the posterior pocket of the apparatus when unmated so as to facilitate donning and undonning the flexible protector relative to the hard hat.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
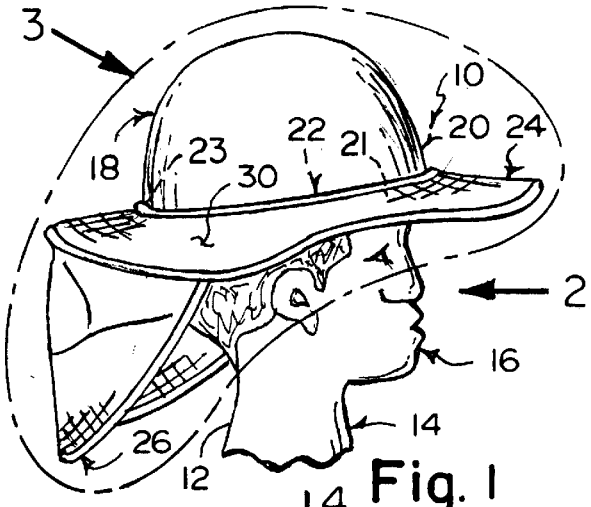
FIG. 1 is a diagrammatic side elevational view of the present invention in use.

10 flexible protector for back 12 of neck 14 of wearer 16 of hard hat 18
12 back of neck 14 of wearer 16 of hard hat 18
14 neck of wearer 16 of hard hat 18
16 wearer of hard hat 18
18 hard hat
20 crown of hard hat 18
21 anterior portion of peak 22 of hard hat 18
22 peak of hard hat 18
23 posterior portion of peak 22 of hard hat 18
24 brim for receiving crown 20 of hard hat 18 and for resting on peak 22 of hard hat 18
26 drape for protecting back 12 of neck 14 of wearer 16 of hard hat 18
29 apparatus for selectively maintaining brim 24 on hard hat 18
30 uppermost surface of brim 24
32 lowermost surface of brim 24
34 anterior portion of lowermost surface 32 of brim 24
36 posterior portion of lowermost surface 32 of brim 24
38 outer perimeter of posterior portion 36 of lowermost surface 32 of brim 24
39 inner perimeter of posterior portion 36 of lowermost surface 32 of brim 24
40 anterior pocket of apparatus 29 for releasably capturing anterior portion 21 of peak 22 of hard hat 18
42 posterior pocket of apparatus 29 for releasably capturing posterior portion 23 of peak 22 of hard hat 18
43 free edge of posterior pocket 42 of apparatus 29
44 mating portions of hook and loop fasteners of apparatus 29 for retaining posterior portion 23 of peak 22 of hard hat 18 in posterior pocket 42 of apparatus 29 when mated and for surrendering posterior portion 23 of peak 22 of hard hat 18 from posterior pocket 42 of apparatus 29 when unmated so as to facilitate donning and undonning of flexible protector 10 relative to hard hat 18

DETAILED DESCRIPTION OF THE PREFERRED EMBODIMENT

Figure 2:
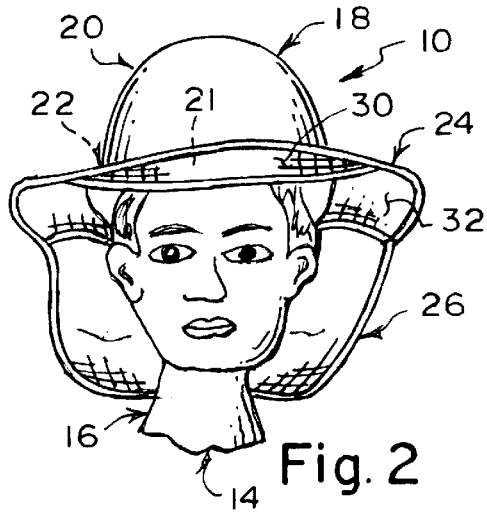
FIG. 2 is a diagrammatic front elevational view taken generally in the direction of arrow 2 in FIG. 1.
Figure 3:
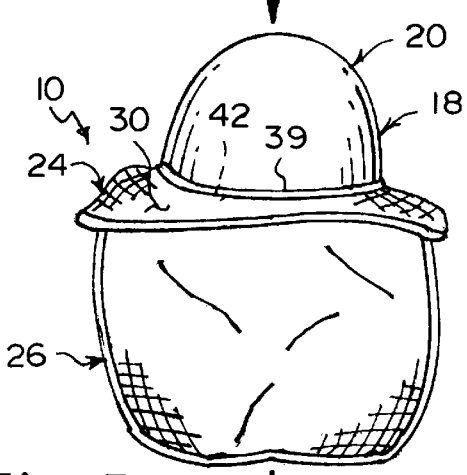
FIG. 3 is a diagrammatic rear elevational view of the area generally enclosed by the dotted curve identified by arrow 3 on FIG. 1 of the present invention.
Figure 4:
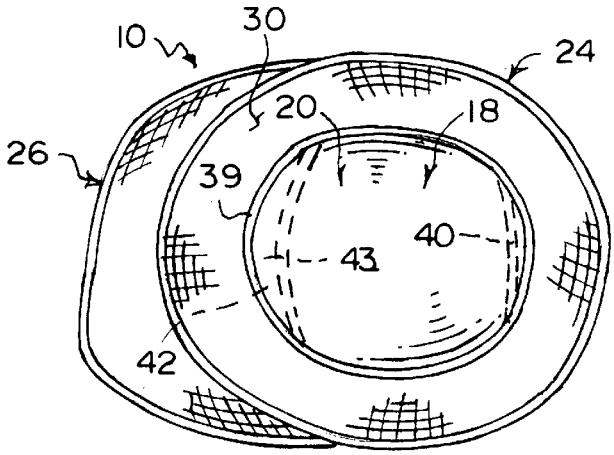
FIG. 4 is a diagrammatic top plan view top plan view taken generally in the direction of arrow 4 in FIG. 3.
Figure 5:
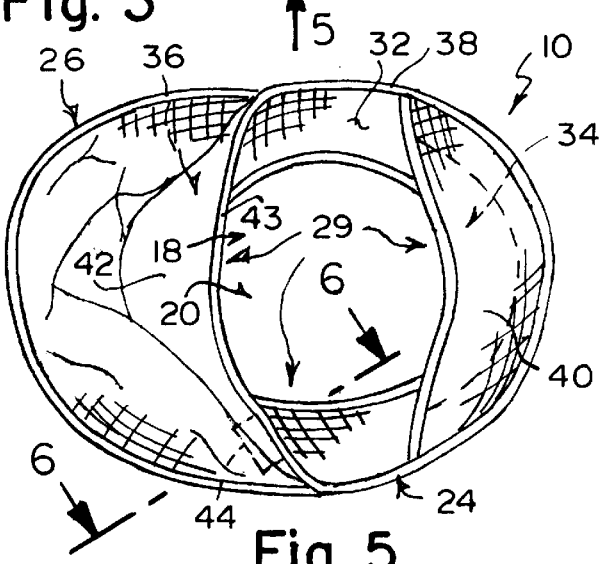
FIG. 5 is a diagrammatic bottom plan view top plan view taken generally in the direction of arrow 5 in FIG. 3.
Figure 6:
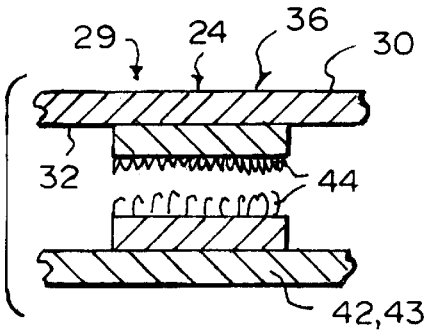
FIG. 6 is an enlarged diagrammatic cross sectional view taken on line 6—6 in FIG. 5.

Referring now to the figures, in which like numerals indicate like parts, and particularly to FIGS. 1 and 2, the flexible protector of the present invention is shown generally at 10 for the back 12 of the neck 14 of a wearer 16 of a hard hat 18, wherein the hard hat 18 has a crown 20 and a peak 22 with an anterior portion 21 and a posterior portion 23.

The configuration of the flexible protector 10 can best be seen in FIGS. 3–6, and as such, will be discussed with reference thereto.

The flexible protector 10 comprises a brim 24 for receiving the crown 20 of the hard hat 18 and for resting on the peak 22 of the hard hat 18.

The flexible protector 10 further comprises a drape 26 depending from the brim 24 for protecting the back 12 of the neck 14 of the wearer 16 of the hard hat 18.

The flexible protector 10 further comprises apparatus 29 associated with the brim 24 for selectively maintaining the brim 24 on the hard hat 18.

The brim 24 is flat, donut-shaped, and has an uppermost surface 30 and a lowermost surface 32 with an anterior portion 34 and a posterior portion 36 that has an outer perimeter 38 and an inner perimeter 39.

The drape 28 depends from the outer perimeter 38 of the posterior portion 36 of the lowermost surface 32 of the brim 24.

The apparatus 29 comprises an anterior pocket 40 that depends from the anterior portion 34 of the lowermost surface 32 of the brim 24 for releasably capturing the anterior portion 21 of the peak 22 of the hard hat 18.

The apparatus 29 further comprises a posterior pocket 42 that depends from the posterior portion 36 of the lowermost surface 32 of the brim 24 for releasably capturing the posterior portion 23 of the peak 22 of the hard hat 18, and has a free edge 43.

The posterior pocket 42 of the apparatus 29 is affixed between the posterior portion 36 of the lowermost surface 32 of the brim 24 and the drape 28.

The apparatus 29 further comprises mating portions of hook and loop fasteners 44 that are disposed on facing surfaces of the inner perimeter 39 of the posterior portion 36 of the lowermost surface 32 of the brim 24 and the free edge 43 of the posterior pocket 42 of the apparatus 29 for retaining the posterior portion 23 of the peak 22 of the hard hat 18 in the posterior pocket 42 of the apparatus 29 when mated and for surrendering the posterior portion 23 of the peak 22 of the hard hat 18 from the posterior pocket 42 of the apparatus 29 when unmated so as to facilitate donning and undonning of the flexible protector 10 relative to the hard hat 18.

Figure 7:
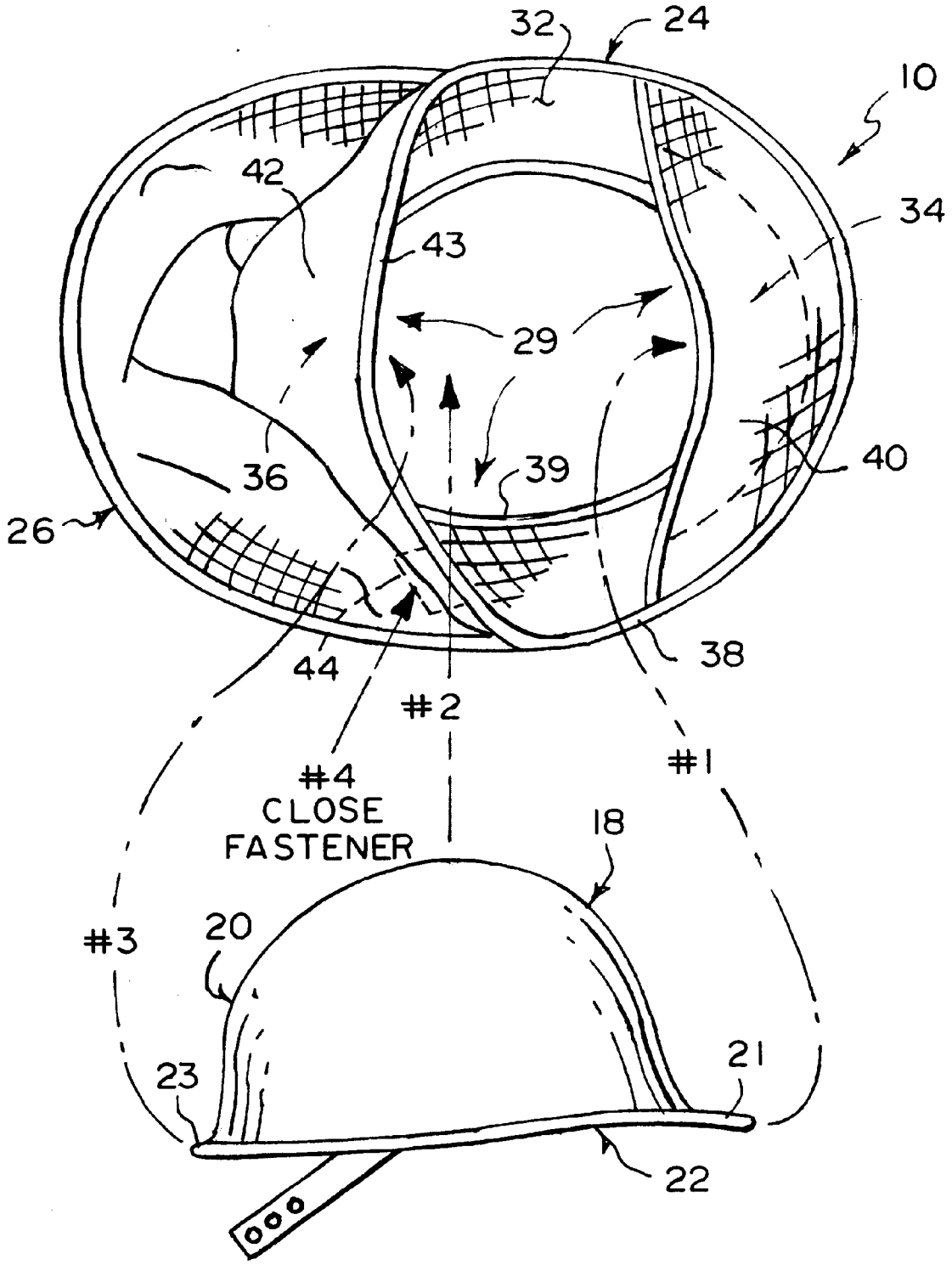
FIG. 7 is an enlarged exploded view of FIGS. 1 and 2 illustrating attaching the present invention to a hard hat.

The method of attaching the flexible protector 10 to the hard hat 18 can best be seen in FIG. 7, and as such, will be discussed with reference thereto.

STEP 1: Unmate the mating portions of hook and loop fasteners 44 of the apparatus 29.

STEP 2: Insert the anterior portion 21 of the peak 22 of the hard hat 18 into the anterior pocket 40 of the apparatus 29, from the lowermost surface 32 of the brim 24.

STEP 3: Insert the crown 20 of the hard hat 18 through the brim 24.

STEP 4: Insert the posterior portion 23 of the peak 22 of the hard hat 18 into the posterior pocket 42 of the apparatus 29, from the lowermost surface 32 of the brim 24.

STEP 5: Mate the mating portions of hook and loop fasteners 44 of the apparatus 29 and thereby capturing the anterior portion 21 of the peak 22 of the hard hat 18 in the anterior pocket 40 of the apparatus 29 and the posterior portion 23 of the peak 22 of the hard hat 18 in the posterior pocket 42 of the apparatus 29.

It will be understood that each of the elements described above, or two or more together, may also find a useful application in other types of constructions differing from the types described above.

While the invention has been illustrated and described as embodied in a flexible protector for the back of the neck of a wearer of a hard hat, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A flexible protector for the back of the neck of a wearer of a hard hat, wherein the hard hat has a crown and a peak with an anterior portion and a posterior portion, said protector comprising:

a) a brim for receiving the crown of the hard hat and for resting on the peak of the hard hat;

b) a drape depending from said brim for protecting the back of the neck of the wearer of the hard hat; and c) apparatus associated with said brim for selectively maintaining said brim on the hard hat, wherein said brim is flat, donut-shaped, and has:

I) an uppermost surface; and

II) a lowermost surface with:

i) an anterior portion; and ii) a posterior portion that has:

1) an outer perimeter; and 2) an inner perimeter, wherein said drape depends from said outer perimeter of said posterior portion of said lowermost surface of said brim, wherein said apparatus comprises an anterior pocket that depends from said anterior portion of said lowermost surface of said brim for releasably capturing the anterior portion of the peak of the hard hat.

2. The protector as defined in claim 1, wherein said apparatus further comprises a posterior pocket that depends from said posterior portion of said lowermost surface of said brim for releasably capturing the posterior portion of the peak of the hard hat, and has a free edge.

3. The protector as defined in claim 2, wherein said posterior pocket of said apparatus is affixed between said posterior portion of said lowermost surface of said brim and said drape.

4. The protector as defined in claim 2, wherein said apparatus further comprises mating portions of hook and loop fasteners that are disposed on facing surfaces of said inner perimeter of said posterior portion of said lowermost surface of said brim and said free edge of said posterior pocket of said apparatus for retaining said posterior portion of said peak of said hard hat in said posterior pocket of said apparatus when mated and for surrendering said posterior portion of said peak of said hard hat from said posterior pocket of said apparatus when unmated so as to facilitate donning and undonning of said flexible protector relative to the hard hat by unmating said mating portions of hook and loop fasteners of said apparatus, inserting the anterior portion of the peak of the hard hat into said anterior pocket of said apparatus, from said lowermost surface of said brim, inserting the crown of the hard hat through said brim, inserting the posterior portion of the peak of the hard hat into said posterior pocket of said apparatus, from said lowermost surface of said brim, and mating said mating portions of hook and loop fasteners of said apparatus and thereby capturing the anterior portion of the peak of the hard hat in said anterior pocket of said apparatus and the posterior portion of the peak of the hard hat in said posterior pocket of said apparatus.

* * * * *